US005302035A

United States Patent [19]

Ueda

[11] Patent Number: 5,302,035

[45] Date of Patent: Apr. 12, 1994

[54] METHOD OF DRIVING WIRE-DOT PRINT HEAD

[75] Inventor: Michio Ueda, Gamagoori, Japan

[73] Assignee: Brother Kogyo Kabushiki Kaisha, Nagoya, Japan

[21] Appl. No.: 962,750

[22] Filed: Oct. 19, 1992

[30] Foreign Application Priority Data

Oct. 18, 1991 [JP] Japan ..... 3-299790

[51] Int. Cl.[5] ..... B41J 2/30

[52] U.S. Cl. ..... 400/124; 400/157.3; 400/167; 101/93.02; 101/93.03; 101/93.05

[58] Field of Search ..... 400/121, 124, 157.2, 400/157.3, 166, 167; 101/93.02, 93.03, 93.29

[56] References Cited

U.S. PATENT DOCUMENTS

| | | | |
|---|---|---|---|
| 4,102,265 | 7/1978 | Deetz | 101/93.03 |
| 4,162,858 | 7/1979 | Brandenburg | 400/166 |
| 4,291,992 | 9/1981 | Barr et al. | 400/167 |
| 4,333,398 | 6/1982 | Carson, Jr. et al. | 400/166 |
| 4,569,607 | 2/1986 | Takemoto | 400/157.3 |
| 5,167,459 | 12/1992 | Yano et al. | 400/124 |

FOREIGN PATENT DOCUMENTS

| | | | |
|---|---|---|---|
| 89975 | 6/1982 | Japan | 400/166 |
| 165278 | 10/1982 | Japan | 400/166 |
| 139458 | 7/1985 | Japan | 400/167 |

OTHER PUBLICATIONS

W. T. Pimbley; "Settle Out Control for Moving Print Hammer"; *IBM TDB;* vol. 21, No. 6, Nov. 1978; pp. 2283–2284.

*Primary Examiner*—David A. Wiecking
*Attorney, Agent, or Firm*—Oliff & Berridge

[57] ABSTRACT

To suppress a secondary bound of a print wire of a dot matrix printer which may occur after a single dot or continuous dots are printed and also to prevent both density variation of printed characters and printing ghost from occurring, a braking pulse is applied after application of a printing pulse in the case of printing the single dot and after a printing pulse of the trailing print cycle in the case of printing the continuous dots. The duration of the braking pulse to be applied after the application of the printing pulse in the trailing print cycle of the continuous dot printing is set to be shorter than the duration of the braking pulse applied after the printing pulse in the case of printing the single dot.

9 Claims, 6 Drawing Sheets

A1,A2,Ae : DURATION OF PRINTING PULSE
B1,B2,Be : DURATION OF BRAKING PULSE
C1,C2,Ce : BRAKING PULSE APPLYING TIMING
D : DELAY TIME
T : PRINT CYCLE

A,A2 : DURATION OF PRINTING PULSE
B : DURATION OF BRAKING PULSE
Ce : BRAKING PULSE APPLYING TIMING
D : DELAY TIME
T : PRINT CYCLE

A : DURATION OF PRINTING PULSE
B : DURATION OF BRAKING PULSE
C : BRAKING PULSE APPLYING TIMING

A1,A2,Ae : DURATION OF PRINTING PULSE
B1,B2,Be : DURATION OF BRAKING PULSE
C1,C2,Ce : BRAKING PULSE APPLYING TIMING
D : DELAY TIME
T : PRINT CYCLE

A1,A2 : DURATION OF PRINTING PULSE
Be : DURATION OF BRAKING PULSE
Ce : BRAKING PULSE APPLYING TIMING
D : DELAY TIME
T : PRINT CYCLE

A1 : DURATION OF PRINTING PULSE
B1 : DURATION OF BRAKING PULSE
C1 : BRAKING PULSE APPLYING TIMING

METHOD OF DRIVING WIRE-DOT PRINT HEAD

BACKGROUND OF THE INVENTION

1. Field of the invention

The present invention relates to a method of driving a wire dot print head which drives print wires to make dot impressions on a printing medium.

2. Description of the Prior Art

Wire-dot printers include an actuator for driving a print wire. The actuator is supplied with an electric power from a power source via a switching element. To drive a print wire, a printing pulse is applied for a predetermined duration to the associated switching element to render it conductive.

Heretofore, it has been proposed to apply a braking pulse to the switching element to render it conductive following the application of the printing pulse thereto. The braking pulse is applied to the switching element for a duration shorter than the duration of the printing pulse so that printing is not carried out in response to the braking pulse. While a high speed printing can be achieved if the braking pulse is not inserted after the printing pulse, the braking pulse is needed for controlling or adjusting the printing speed in order to weaken a stress of a stopper resulting from the impingement of the print wire thereon and to thus suppress secondary bound of the printing wire back from the stopper. Further, the braking pulse needs to be inserted when a special mode of printing such as double speed printing or odd- and even-number dot separate printing is carried out. For such reasons, the braking pulse is inserted for each dot printing.

FIGS. 1 and 2 show curves indicating displacement of a print wire and timing charts of the printing and braking pulses according to conventional driving methods. FIG. 1 shows the case when continuous-shot drive is performed to print a series of dots and FIG. 2 shows the case when single-shot drive is performed to print a single dot in a discontinuous manner. As can be appreciated from FIG. 1, the duration of the printing pulse A and the application timing of the braking pulse B with respect to the associated printing pulse A are the same in the successive print cycles T. In the case of single-shot drive shown in FIG. 2, the duration of the print pulse A is set to be equal to that of the leading printing pulse in the continuous-shot drive.

FIGS. 3 and 4 show another conventional driving method wherein in the case of continuous-shot drive, a braking pulse is applied only after the application of the trailing printing pulse.

As a result of experiments, the present inventor has found that even if the secondary bound of a print wire back from a stopper could be effectively prevented in the single-shot drive by the application of the braking pulse, the same approach is not applicable to the case when continuous-shot drive is carried out. Specifically, the secondary bound of the print wire cannot be prevented from occurring after the impression of trailing dot even if the similar control as in the single-shot drive is adopted for the continuous-.shot drive, as can be appreciated from the waveforms Ma in FIGS. 1 and 3. If the secondary bound of the print wire occurs, the density of printed image become uneven and print ghost appears.

SUMMARY OF THE INVENTION

The present invention has been made to solve the above-noted problems, and accordingly it is an object of the invention to provide a print head driving method with which secondary bound of a print wire back from a stopper can be effectively prevented from occurring and generation of print density variation and print ghost can be eliminated.

To achieve the above and other objects, the present invention provides a method of driving a wire dot printer head having an actuator for driving a print wire in response to a pulse signal having a duration. A dot impression is made on a recording medium when the print wire is driven in response thereto. Immediately after driving the actuator for making a leading dot impression of a series of dot impressions to be made on the recording medium, the actuator is driven in response to a first pulse signal having a first duration shorter than the duration of the pulse signal for making the leading dot impression. A dot impression is not made in response to the first pulse signal. Immediately after driving the actuator for making a trailing dot impression of the series of dot impressions to be made on the recording medium, the actuator is driven in response to a second pulse signal having a second duration shorter than the first duration of the first pulse signal. A dot impression is not made in response to the second pulse signal.

When making a single dot impression in discontinuous manner, the first pulse signal is applied immediately after driving the actuator for making the single dot impression.

The duration of the pulse signal for making the trailing dot impression is shorter than the duration of the pulse signal for making the initial dot impression. Further, a first period of time from a start of the pulse signal for making the trailing dot impression to application of the second pulse signal is shorter than a second period of time from a start of the pulse signal for making the leading dot impression to application of the first pulse signal.

BRIEF DESCRIPTION OF THE DRAWINGS

The particular features and advantages of the invention as well as other objects will become apparent from the following description taken in conjunction with the accompanying drawings, in which.

DETAILED DESCRIPTION OF THE PREFERRED EMBODIMENTS

While the wire-dot print head driving method of the present invention is susceptible of numerous physical embodiments depending upon the environment and requirements of use, substantial numbers of the herein shown and described embodiments have been made, tested and used, and all have performed in an eminently satisfactory manner.

Figure 1:
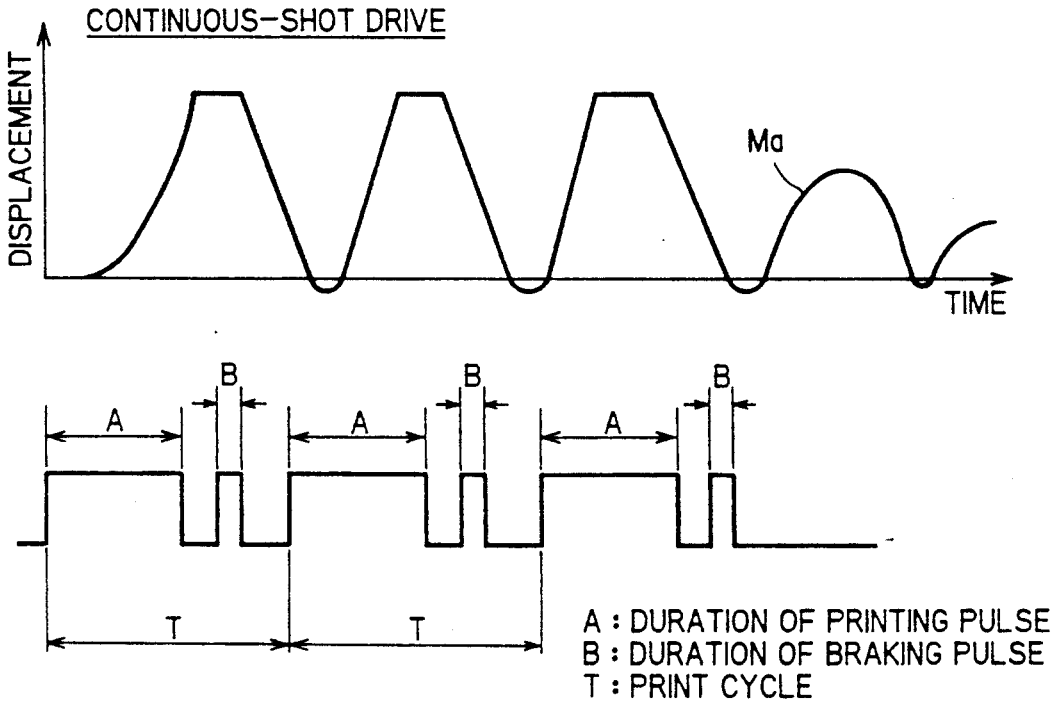
FIG. 1 PRIOR ART
FIG. 1 is a diagram illustrating a continuous-shot drive and a displacement of a print wire according to a first conventional driving method.
Figure 2:
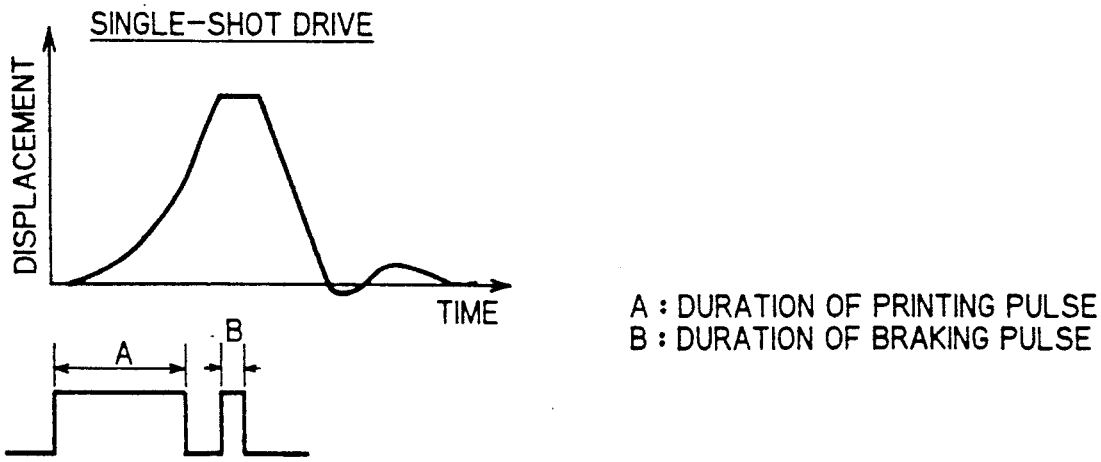
FIG. 2 PRIOR ART
FIG. 2 is a diagram illustrating a single-shot drive and a displacement of a print wire according to the first conventional driving method.
Figure 3:
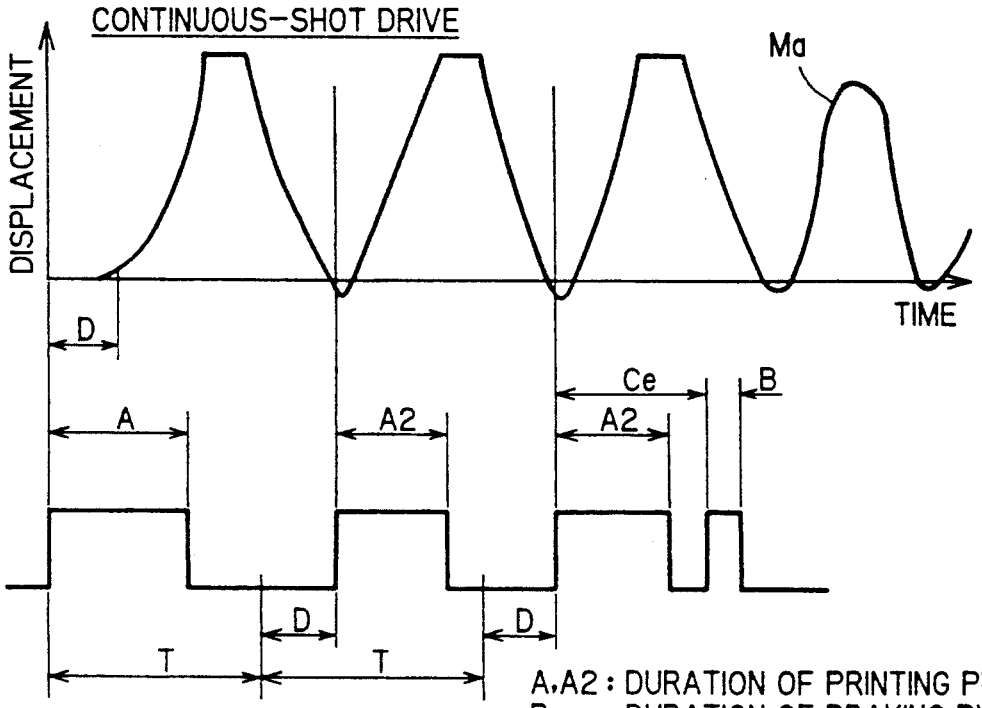
FIG. 3 PRIOR ART
FIG. 3 is a diagram illustrating a continuous-shot drive and a displacement of a print wire according to a second conventional driving method, wherein a braking pulse is applied only after the final dot drive is performed.
Figure 4:
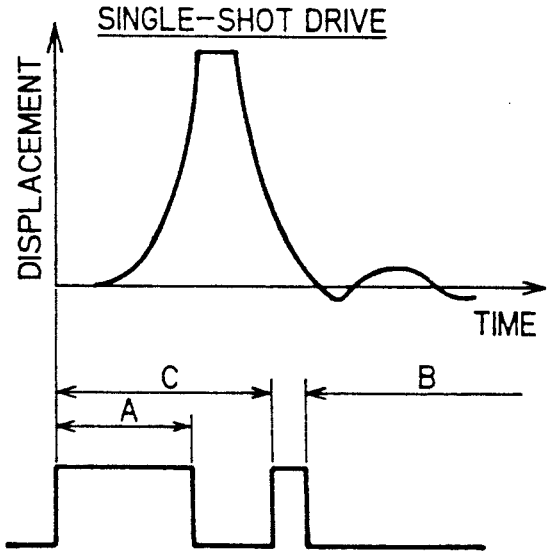
FIG. 4 PRIOR ART
FIG. 4 is a diagram illustrating a single-shot drive and a displacement of a print wire according to the second conventional driving method.
Figure 5:
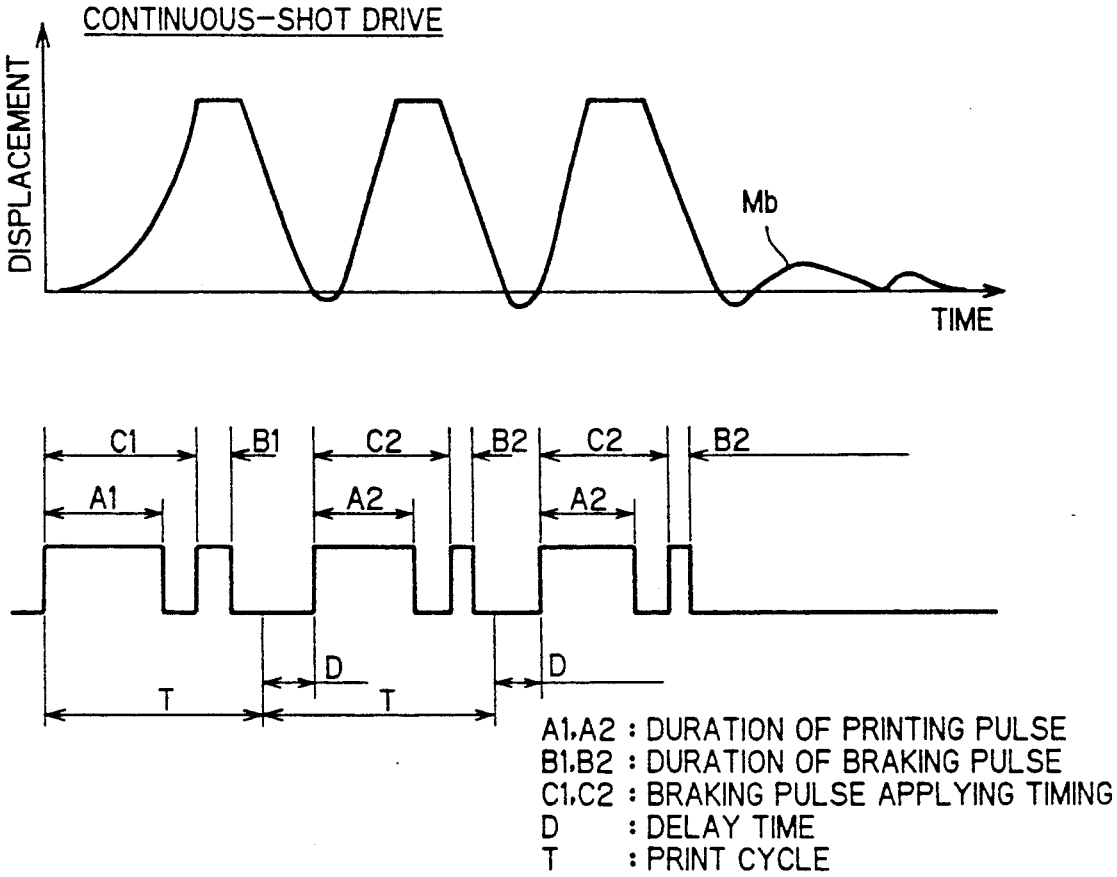
FIG. 5 is a diagram illustrating a continuous-shot drive and a displacement of a print wire according to a first embodiment of the present invention.
Figure 6:
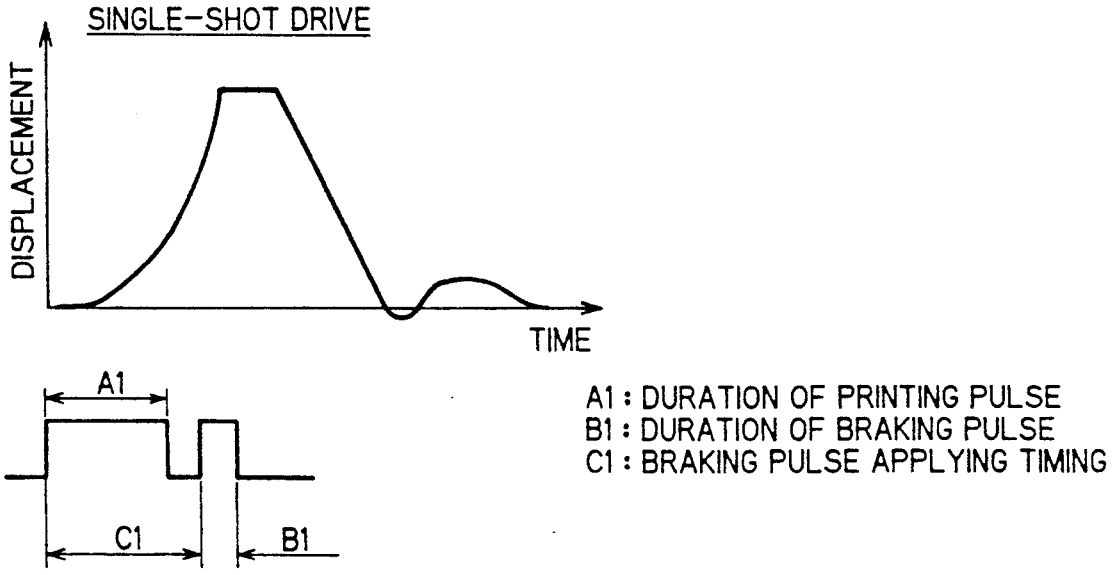
FIG. 6 is a diagram illustrating a single-shot drive and a displacement of a print wire according to the first embodiment of the present invention.

A first embodiment of the present invention will be described hereunder with reference to FIGS. 5 and 6. FIG. 5 shows a displacement of a print wire and a relation between application timings of a printing pulse and a braking pulse inserted thereafter in the case of a continuous-shot drive. The continuous-shot drive is herein defined by continuously driving a print wire to thus make a series of dot impressions on a printing medium. The braking pulse has a short duration which does not allow the print wire to make a dot impression on the printing medium. FIG. 6 is directed to the case of single-shot drive for making a single dot impression on the printing medium. The waveforms of the printing pulse and the braking pulse shown in FIGS. 5 and 6 indicate voltage waveforms to be applied to a switching element through which an electric power is supplied to an actuator. It should be noted that the waveforms shown in FIGS. 5 and 6 are not illustrative of current flowing in the actuator. Actuation of the print wire by the actuator is delayed by a brief period of time from the time when the printing pulse is applied to the switching element.

According to the first embodiment, for the leading dot to be printed with the continuous-shot drive and the dot to be printed with the single-shot drive, the duration of the printing pulse is set to be A1 and the duration of the braking pulse is set to be B1. With respect to the dots to be printed following the leading dot in the continuous-shot drive, the duration A2 of the printing pulse is set to be shorter than the duration A1 and the duration of the braking pulse B2 is also set to be shorter than the duration B1. Further, for the leading dot to be printed in the continuous-shot drive and the dot to be printed in the single-shot drive, the braking pulse applying Liming is set to be a time instant at which a period of time C1 is expired from the start of application of the leading printing pulse. For the dots to be printed following the leading dot in the continuous-shot drive, the braking pulse applying timing is set to be a time instant at which a period of time C2 is expired from the start of application of the printing pulse, wherein the time C2 is shorter than the time C1. The start of the printing pulses for the dots to be printed following the leading dot in the continuous-shot drive is delayed by a time D from the end of the preceding print cycle.

With the control of print wire drive as described above, the secondary bound of the print wire back from a stopper can be suppressed as shown by the curve Mb in FIG. 5. Compliance of the print wire with respect to the printing pulse is enhanced, since the duration of the printing pulse is for the dots to be printed following the leading dot in the continuous-shot drive is set to be shorter than that for the dot to be initially printed.

Figure 7:
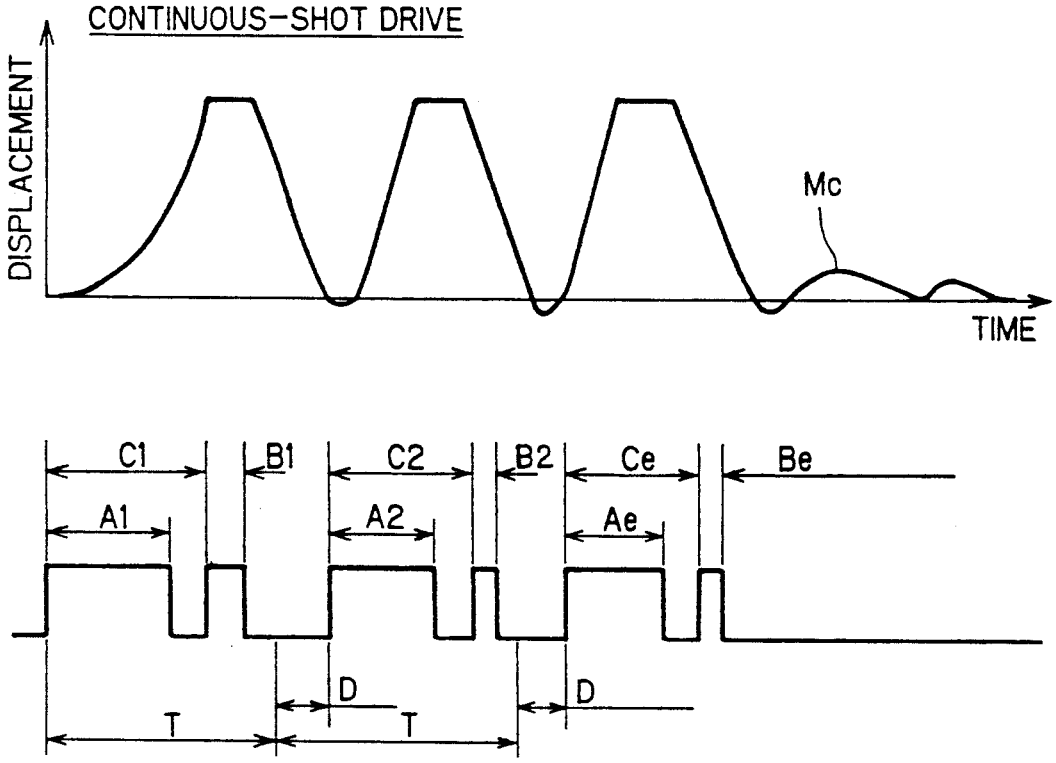
FIG. 7 is a diagram illustrating a continuous-shot drive and a displacement of a print wire according to a second embodiment of the present invention.

FIG. 7 shows a second embodiment of the invention. The second embodiment pertains to the continuous-shot drive. In this embodiment, the durations of the printing pulse and the braking pulse and also the braking pulse applying timing in the intervening print cycles are set to be the same relation as in FIG. 5 with respect to those in the leading print cycle, however, those in the trailing print cycle are set to be different from those of the intervening print cycles. Specifically, the duration of the printing pulse for the trailing dot is set to be Ae which is shorter in time than A2, the duration of the braking pulse for the trailing dot is set to be Be which is also shorter than B2, and the braking pulse applying timing is set to be Ce which is shorter than C2. With the control of print wire drive as described above, the secondary bound of the print wire can also be suppressed as shown by the curve Mc in FIG. V.

Figure 8:
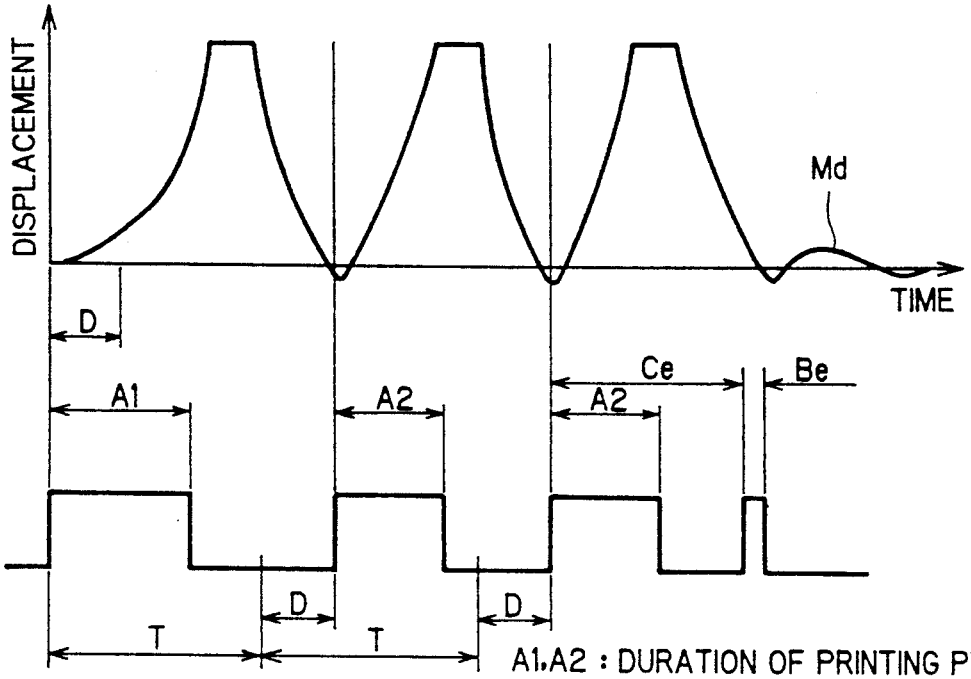
FIG. 8 is a diagram illustrating a continuous-shot drive and a displacement of a print wire according to a third embodiment of the present invention.
Figure 9:
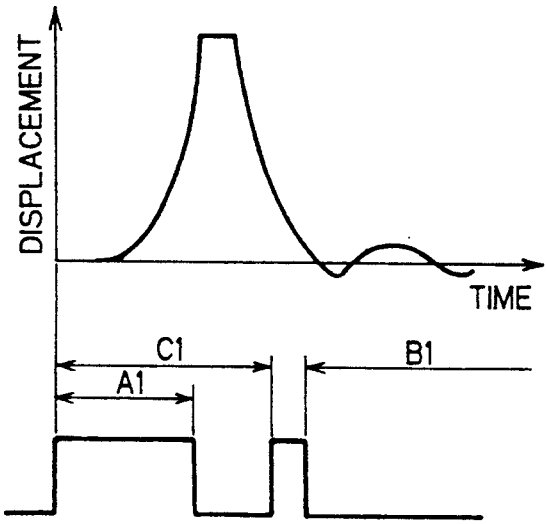
FIG. 9 is a diagram illustrating a continuous-shot drive and a displacement of a print wire according to the third embodiment of the present invention.

FIGS. 8 and 9 show a third embodiment of the invention. FIG. 8 is directed to the continuous-shot drive and FIG. 9 to the single-shot drive. In the third embodiment, the braking pulse is inserted only in the trailing print cycle in the continuous-shot drive, and the duration A2 of the printing pulse for the dots to be printed following the is leading dot in the continuous-shot drive is sat to be shorter than the duration A1 of the printing pulse for the leading dot to be printed in the continuous-shot drive and the dot to be printed in the single-shot drive. The duration Be of the braking pulse inserted in the trailing print cycle in the continuous-shot drive is set to be shorter than the duration B1 of the braking pulse in the single-shot drive. Further, the braking pulse applying timing Ce in the trailing print cycle in the continuous-shot drive is set to be shorter than the braking pulse applying timing C1 in the single-shot drive. With the control of the print wire drive as described above, the secondary bound of the print wire can also be suppressed as shown by the curve Md in FIG. 8.

As described, the durations of the printing pulse and the braking pulse are determined in accordance with the following conditions:

(a) the dot to be printed by the single-shot drive;

(b) the leading dot to be printed by the continuous-shot drive;

(c) the intervening dots to be printed by the continuous-shot drive; and (d) the trailing dot of a series of dots to be printed by the continuous-shot drive. See FIGS. 8 and 9.

Determinations of the above conditions (a) through (d) will be explained with respect to the third embodiment while referring to circuits to implement the determinations. To facilitate the understanding, it is now assumed that terminals A. B and C of the circuits shown in FIGS. 11(*a*) through 11(D) are connected respectively to terminals A, B and C of the circuit shown in FIG. 10.

Figure 10:
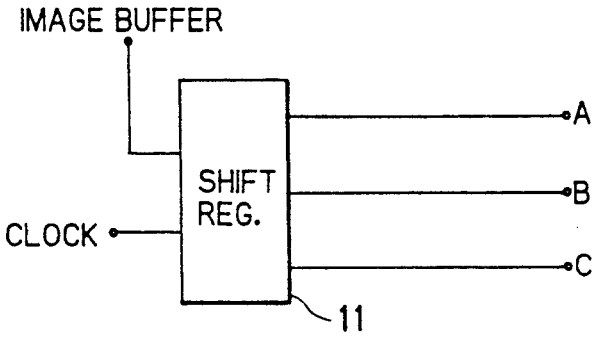
FIG. 10 is a block diagram showing a partial arrangement for discriminating one of a dot print with a single-shot drive, a leading dot print with a continuous-shot drive- and a trailing dot print with the continuous-shot drive.
Figure 11A:
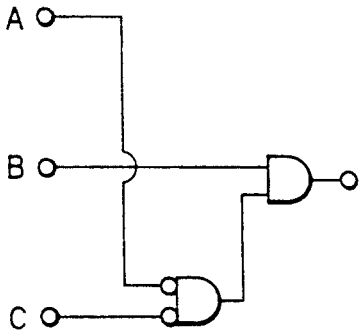
FIGS. 11(*a*) through 11(*d*) are circuit diagrams for use in combination with the arrangement shown in FIG. 10.
Figure 11B:
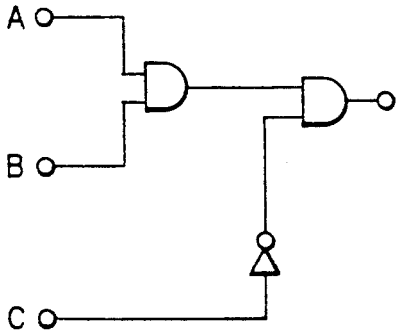
Figure 11C:
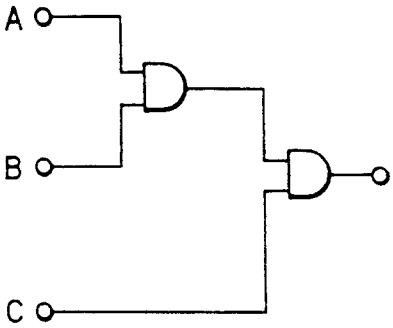
Figure 11D:
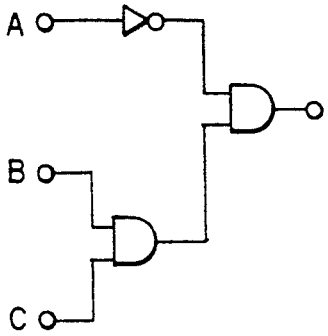

The circuit shown in FIG. 10 includes a shift register 11 having a first input terminal connected to an image buffer and a second input terminal supplied with clock pulses. The image buffer temporarily stores print data and supplies dot-developed serial data to the shift register on a print wire basis in timed relation with the clock pulses. From output terminals A, B and C of the shift register 11, presently input data, precedingly input data, and two preceding input data are output which data are named as next print data, present print data and previous print data, respectively.

With reference to the circuit shown in FIG. 11(*a*), when the terminal B is high indicating that dot to be printed at this time is present and the terminals A and C are both low indicating that there are no dots to be printed next time and previously printed, the output of the circuit becomes high. With the circuit shown in FIG. 11(*a*), the condition (a) can be discriminated. If the output of the circuit shown in FIG. 11(*a*) is high, the duration of the printing pulse is set to A1. After expiration of time C1 from the start of application of the printing pulse A1, the braking pulse is applied for the duration of B1.

With reference to the circuit shown in FIG. 11(*b*), when both the terminals A and B are high indicating that dots are to be printed this time and next time and the terminal C is low indicating that there is no dot previously printed, the output of the circuit becomes high. Therefore, the condition (b) can be discriminated with the circuit shown. When the output of the circuit shown in FIG. 11(*b*) is high, the duration of the printing pulse is set to A2 which is shorter than A1.

With reference to the circuit shown in FIG. 11(*c*) when all the terminals A, B and C: are high indicating that three consecutive dots are to be printed, the output of the circuit becomes high. Therefore, the condition (c) can be discriminated with the circuit shown. When the output of the circuit shown in FIG. 11(*c*) is high, the printing pulse having the duration A2 is produced after expiration of the delay time D. The duration A2 is shorter than the duration A1.

Finally, with reference to the circuit shown in FIG. 11(*d*), when both the terminals B and c are high indicating that the dot is to be printed this time and the dot was printed previously and the terminal A is low indicating that the dot is not to be printed next time, the output of the is circuit becomes high. Therefore, the condition (d) can be discriminated with the circuit shown in FIG. 11(*d*). When the output of the circuit shown therein is high, the printing pulse having the duration A2 is produced after expiration of the delay time D. Further, after expiration of time Ce from the occurrence of the printing pulse, the braking pulse having the duration of Be is produced. The duration Be is shorter than the duration B1, and the time Ce is shorter than the time C1. With the control as described, the driving control of the print head can be adequately implemented. In accordance with this embodiment, the control of the print head can be achieved highly efficiently because not only the durations of the printing pulse and braking pulse but also the braking pulse application timing are selected to be optimum values.

While the present invention has been described with respect to specific embodiments, it can be appreciated to those skilled in the art that many changes and modifications may be made without departing from the scope and spirit of the present invention. For example, the effects described above can be obtained if the braking pulse is added after the single-shot drive printing pulse and after the printing pulse in the trailing print cycle of the continuous-shot drive and if the duration of the braking pulse of the continuous-shot drive is set to be shorter than that of the braking pulse of the single-shot drive.

What is claimed is:

1. A method of driving a wire dot printer head having an actuator for driving a print wire in response to a pulse signal having a duration, a dot impression being made on a recording medium when the print wire is driven in response thereto, comprising the steps of:

immediately after driving the actuator for making a leading dot impression of a series of dot impressions to be made on the recording medium in response to a leading pulse signal, driving the actuator in response to a first pulse signal having a duration shorter than the duration of the leading pulse signal for making the leading dot impression, a dot impression not being made in response to the first pulse signal; and immediately after driving the actuator for making a trailing dot impression of the series of dot impressions to be made on the recording medium in response to a trailing pulse signal, driving the actuator in response to a second pulse signal having a duration shorter than the duration of the first pulse signal, a dot impression being not made in response to the second pulse signal, wherein the duration of the trailing pulse signal is shorter than the duration of the leading pulse signal and a first period of time from a start of the trailing pulse signal to application of the second pulse signal is shorter than a second period of time from a start of leading pulse signal to application of the first pulse signal.

2. The method according to claim 1, wherein when making a single dot impression in discontinuous manner, the first pulse signal is applied immediately after driving the actuator for making the single dot impression.

3. The method according to claim 2, wherein the first pulse signal applied immediately after driving the actuator for making the single dot impression is longer than the duration of the second pulse signal applied immediately after driving the actuator for making the trailing dot impression of the series of dot impressions.

4. The method according to claim 2, wherein a period of time from a start of the pulse signal for making the single dot impression to application of the first pulse signal is substantially equal to a first period of time from a start of the pulse signal for making the leading dot impression to application of the first pulse signal, and wherein the first period of time is shorter than a second period of time from a start of the pulse signal for making the trailing dot impression to application of the second pulse signal.

5. The method according to claim 4, wherein the first pulse signal applied immediately after driving the actuator for making the single dot impression is longer than the duration of the second pulse signal applied immediately after driving the actuator for making the trailing dot impression of the series of dot impressions.

6. A method of driving a wire dot printer head having an actuator for driving a print wire, a power source, and a switching element connecting the power source to the actuator when the switching element is rendered ON, comprising the steps of:

for making an impression of a leading dot of a series of dot impressions with the print wire, applying a first printing pulse having a duration A1 to the switching element to render the switching element ON;

applying a first braking pulse having a duration B1 shorter than the duration A1 to the switching element to render the switching element ON after expiration of a first predetermined period of time C1 from a start of application of the first printing pulse, a dot impression not being made in response to the first braking pulse;

for making an impression of a dot which follows the leading dot, applying a second printing pulse having a duration A2 shorter than the duration A1 to the switching element to render the switching element ON; and applying a second braking pulse having a duration B2 shorter than the duration B1 to the switching element to render the switching element ON after expiration of a second predetermined period of time C2 from a start of application of the second printing pulse, the second period of time C2 being shorter than the first period of time C1, and a dot of impression not being made in response to the second braking pulse.

7. The method according to claim 6, further comprising steps of:

for making an impression of an independent dot in a discontinuous manner with the print wire, applying the first, printing pulse to the switching element; and thereafter applying the first braking pulse to the switching element after expiration of the first predetermined period of time C1 from the start of application of the first printing pulse.

8. A method of driving a wire dot printer head having an actuator for driving a print wire, a power source, and a switching element connecting the power source to the actuator when the switching element is rendered ON, comprising the steps of;

for making an impression of a leading dot of a series of dot impressions with the print wire, applying a first printing pulse having a duration A1 to the switching element to render the switching clement ON;

applying a first braking pulse having a duration B1 shorter than the duration A1 to the switching element to render the switching element ON after expiration of a first predetermined period of time C1 from a start of application of the first printing pulse, a dot impression not being made in response to the first braking pulse;

for making impressions of intervening dots between the leading dot and a trailing dot of the series of dots, applying a second printing pulse having a duration A2 shorter than the duration A1 to the switching element to render the switching element ON;

applying a second braking pulse having a duration B2 shorter than the duration B1 to the switching element to render the switching element ON after expiration of a second predetermined period of time C2 from a start of application of the second printing pulse, the second period of time C2 being shorter than the first period of time C1, and a dot of impression not being made in response to the second braking pulse;

for making an impression of the trailing dot of the series of dot impressions with the print wire, applying a third printing pulse having a duration Ae shorter than the duration A2 to the switching element to render the switching element ON; and applying a third braking pulse having a duration Be shorter than the duration B2 to the switching element to render the switching element ON after expiration of a third predetermined period of time Ce from a start of application of the third printing pulse, a dot impression not being made in response to the third braking pulse.

9. A method of driving a wire dot printer head having an actuator for driving a print wire, a power source, and a switching element connecting the power source to the actuator when the switching element is rendered ON, comprising the steps of:

applying a first printing pulse to the switching element for making an impression of an independent dot in a discontinuous manner with the print wire;

applying a braking pulse to the switching element after expiration of a predetermined period of time Ce from a start of application of the first printing pulse;

for making an impression of a leading dot of a series of dot impressions with the print wire, reapplying the first printing pulse having a duration A1 to the switching element to render the switching element ON;

for making impressions of intervening dots between the leading dot and a trailing dot of the series of dots, applying a second printing pulse having a duration A2 shorter than the duration A1 to the switching element to render the switching element ON; and applying the braking pulse having a duration Be to the switching element to render the switching element ON after expiration of a predetermined period of time Ce from a start of application of the second printing pulse for printing the trailing dot.

* * * * *